US007677701B2

(12) United States Patent
Xiao

(10) Patent No.: US 7,677,701 B2
(45) Date of Patent: Mar. 16, 2010

(54) MICRO-FLUID EJECTION HEAD WITH EMBEDDED CHIP ON NON-CONVENTIONAL SUBSTRATE

(75) Inventor: Zhigang Xiao, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 698 days.

(21) Appl. No.: 11/551,457

(22) Filed: Oct. 20, 2006

(65) Prior Publication Data

US 2008/0079780 A1 Apr. 3, 2008

Related U.S. Application Data

(60) Provisional application No. 60/827,379, filed on Sep. 28, 2006.

(51) Int. Cl.
*B41J 2/05* (2006.01)

(52) U.S. Cl. ..... 347/58; 347/59

(58) Field of Classification Search ..... 347/12, 347/13, 40, 42, 50, 56–69, 61–65, 67
See application file for complete search history.

(56) References Cited

U.S. PATENT DOCUMENTS

| | | | | |
|---|---|---|---|---|
| 5,697,144 | A * | 12/1997 | Mitani et al. | 347/65 |
| 6,239,980 | B1 | 5/2001 | Fillion et al. | |
| 6,582,062 | B1 | 6/2003 | Childers et al. | |
| 6,799,833 | B2 * | 10/2004 | Watanabe | 347/50 |
| 6,921,156 | B2 | 7/2005 | Childers et al. | |
| 6,958,537 | B2 | 10/2005 | Eng et al. | |
| 6,964,881 | B2 | 11/2005 | Chua et al. | |
| 2003/0184618 | A1 | 10/2003 | Childers et al. | |

* cited by examiner

*Primary Examiner*—Juanita D Stephens

(57) ABSTRACT

Micro-fluid ejection heads and methods for fabricating the same. One such micro-fluid ejection head includes a substrate having a plurality of fluid ejection actuator devices adjacent to a device surface thereof A valley is adjacent to the device surface of the substrate. A semiconductor chip is associated with the plurality of fluid ejection actuator devices. The chip is in the valley adjacent the device surface of the substrate. A conductive material is deposited adjacent to the device surface of the substrate. The deposited conductive material generally conforms to the valley. The conductive material is in electrical flow communication with the chip.

13 Claims, 3 Drawing Sheets

MICRO-FLUID EJECTION HEAD WITH EMBEDDED CHIP ON NON-CONVENTIONAL SUBSTRATE

This application claims the benefit of U.S. Provisional Application No. 60/827,379, filed Sep. 28, 2006.

TECHNICAL FIELD

The disclosure relates to micro-fluid ejection devices and, in one particular embodiment, to relatively large substrate ejection devices using non-conventional substrates and improved methods for manufacturing such devices.

BACKGROUND AND SUMMARY

Conventional micro-fluid ejection heads are designed and constructed with silicon micro-fluid ejection head chips that include both the ejection actuators for ejection of fluids and logic circuits to control the ejection actuators. However, the silicon wafers used to make silicon chips are currently only available in round format because the basic manufacturing process is based on a single seed crystal that is rotated in a high temp crucible to produce a circular boule that is processed into thin circular wafers for the semiconductor industry.

The circular wafer stock is very efficient for relatively small micro-fluid ejection head chips relative to the diameter of the wafer. However, such circular wafer stock is inherently inefficient for use in making large rectangular silicon chips such as chips having a dimension of 2.5 centimeters or greater. In fact the expected yield of silicon chips having a dimension of greater than 2.5 centimeters from a circular wafer is typically less than about 20 chips. Such a low chip yield per wafer makes the cost per chip prohibitively expensive.

Accordingly, there is a need for improved structures and methods for making micro-fluid ejection heads, particularly ejection heads suitable for ejection devices having an ejection swath dimension of greater than about 2.5 centimeters.

In view of the foregoing and/or other needs, exemplary embodiments of the disclosure provide a micro-fluid ejection head including a non-conventional substrate and methods for making large array micro-fluid ejection heads. One exemplary micro-fluid ejection head includes a substrate having a plurality of fluid ejection actuator devices adjacent to a device surface thereof. A valley is adjacent to the device surface. A semiconductor chip associated with the plurality of fluid ejection actuator devices is in the valley adjacent the device surface of the substrate. A conductive material is deposited adjacent to the device surface of the substrate, wherein the deposited conductor material generally conforms to the valley. The conductor material is in electrical flow communication with the chip.

Another exemplary embodiment of the disclosure provides a method for fabricating a micro-fluid ejection head. A conductive material is deposited into a valley of a substrate. The valley is adjacent to a device surface of the substrate. A semiconductor chip is provided in the valley such that the chip is in electrical flow communication with fluid ejection actuators formed adjacent the device surface. The valley is substantially filled with an encapsulant material to substantially planarize the device surface. A nozzle plate is provided adjacent to the device surface of the substrate.

A potential advantage of an exemplary apparatus and method described herein is that large array substrates may be fabricated from non-conventional substrate materials including, but not limited to, glass ceramic, metal, and plastic materials. The term "large array" as used herein means that the substrate is a unitary substrate having a dimension in one direction of greater than about 2.5 centimeters. However, the apparatus and methods described herein may also be used for conventional size ejection head substrates.

Another potential advantage of an exemplary embodiment of the disclosure is an ability to dramatically reduce the amount of semiconductor device area required to drive a plurality of fluid ejection actuators.

BRIEF DESCRIPTION OF THE DRAWINGS

Further advantages of the exemplary embodiments will become apparent by reference to the detailed description when considered in conjunction with the figures, which are not to scale, wherein like reference numbers indicate like elements through the several views, and wherein.

DETAILED DESCRIPTION OF EXEMPLARY EMBODIMENTS

Figure 1:
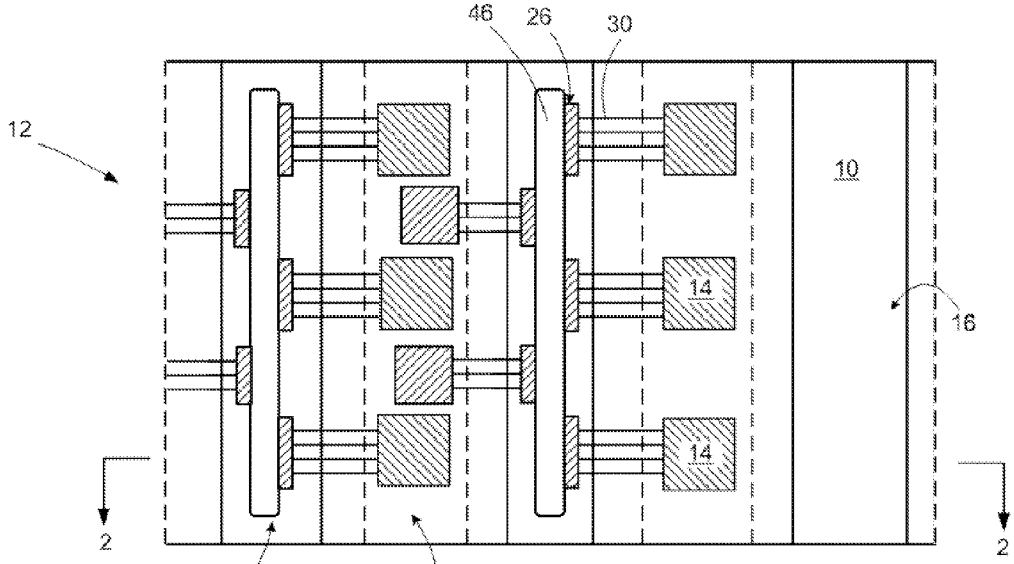
FIG. 1 is a plan view of a portion of a micro-fluid ejection head according to the disclosure as viewed from a device surface thereof.

As described in more detail below, embodiments of the disclosure relate to non-conventional substrates for providing micro-fluid ejection heads. Such non-conventional substrates, unlike conventional silicon substrates, may be provided in large format shapes to provide large arrays of fluid ejection actuators on a single substrate. Such large format shapes are particularly suited to providing page wide printers and other large format fluid ejection devices.

According to the disclosure, a substrate 10 (FIGS. 1 and 2) of a micro-fluid ejection head 12 may be provided by materials such as glass ceramic, metal, plastic, and combinations thereof. A particularly suitable material is a cast or machined non-monocrystalline ceramic material. Such material may be provided with dimensions of greater than about 2.5 centimeters and typically have electrically insulating properties suitable for use as the substrate 10. The substrate 10 may be cast, machined, or molded, for example, to provide valleys 18 and peaks 20, as illustrated more clearly in FIG. 2. Conventional cast, machining and molding techniques may be used to provide the valleys 18 and peaks 20. For example, a corrugating roll may be used to provide the valleys 18 and peaks 20 prior to curing the substrate 10. A semiconductor chip 14 may include, but is not limited to, a driver chip or demultiplexing chip that is associated with the ejection head 12 to control one or more functions of the ejection head 12 or a device to provide an on-board memory for the ejection head 12.

Figure 3:
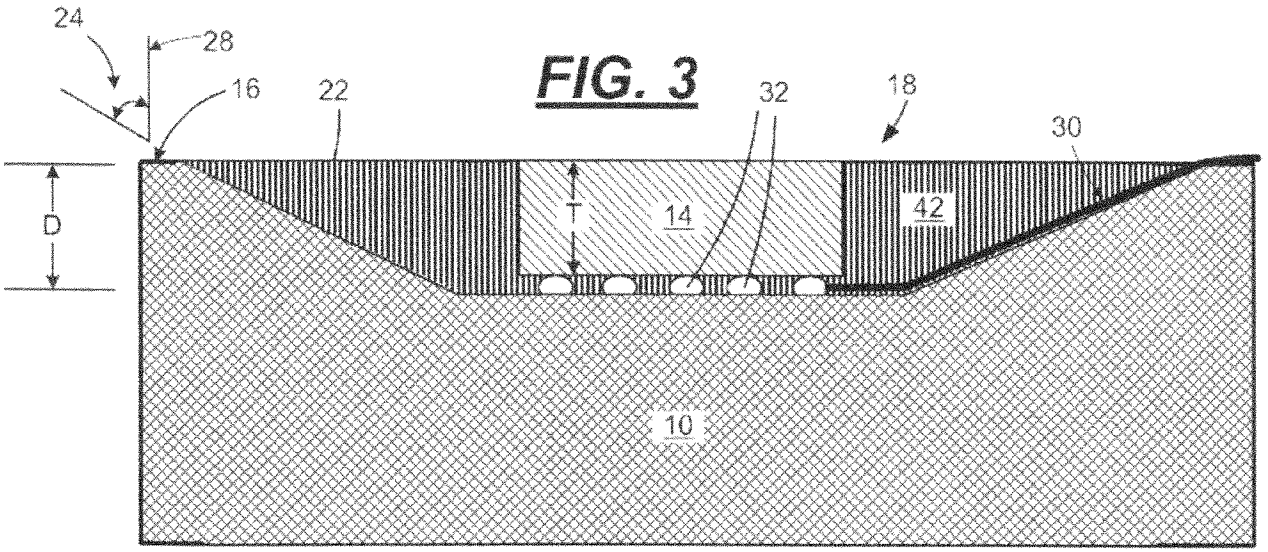
FIG. 3 is an enlarged view of a portion of the micro-fluid ejection head of FIG. 1 showing connection of a semiconductor device in a substrate valley according to embodiments of the disclosure.

With reference to FIG. 3, the valleys 18 desirably have a depth D that is at least equal to or greater than a thickness T of the semiconductor chip 14. The semiconductor chips 14 typically have a thickness T ranging from about 400 to about 800 microns. Accordingly, the corresponding depth D of the valley 18 may also range from about 400 to about 800 microns.

The valley 18 also has sloped side walls 22 having an angle 24 that provides a smooth radius (r) for electrical traces from the chip 14 to fluid ejection actuators 26 adjacent the peak 20 areas of the substrate 10. The angle 24 may range from about 45° to about 80° from an axis 28 substantially perpendicular to the surface 16. An equation for the smooth radius (r) is as follows:

$$r=D\times\sqrt{2}$$

wherein r and D are as defined above. The smooth radius facilitates a continuous formation of thin film conductive layers, such as conductive trace 30 in the region extending between the valley 18 and the peak 20. The smooth radius is more adaptable than a sharper edge to thin film deposition methods and also may reduce residual stress build up in the conductive layers in the transition areas from the peak 20 along the sloped side walls 22 to the valley 18.

In order to provide a surface finish suitable for depositing fluid ejection devices and thin film conductive layers on the device surface 16 of the substrate 10, the device surface 16 of the substrate 10 may be polished to a fine finish and, if desired, coated with a planarizing layer. Polishing alone may be sufficient to provide a surface roughness of less than about 7.5 nanometers, which is generally a sufficiently smooth surface. If not, a layer of glass (for example boro-phosphosilicate glass BPSG) may be applied as by spinning or by chemical vapor depositing (CVD) onto the device surface 16 of the substrate 10. The techniques for applying the planarizing layer are well known in the semiconductor industry for coating silicon devices, but are not commonly used for coating non-conventional substrates such as substrate 10. According to an exemplary embodiment, there is a greater requirement for smoothness and planarity of the device surface 16 than there is for the sloped side walls 22 and valley floor 32 because of the deposition of fluid ejection devices 26 on the device surface 16, whereas only conductive traces 30 and contact pads 34 for the semiconductor chip 14 are provided on the sloped side walls 22 and valley floor 32, respectively, After planarization of the device surface 16 of the substrate 10, a thermal conductive layer may be deposited in a fluid ejection actuator area of the substrate 10 and the fluid ejection actuators 26 and conductors therefor, for example, a thin film resistor layer and an anode and a cathode conductor layer, may be deposited adjacent to the thermal conductive layer. The thin film resistor layer and conductor layer may be patterned and etched using well known semiconductor fabrication techniques to provide a plurality of the fluid ejection actuators 26 on the device surface 16 of the substrate. Suitable semiconductor fabrication techniques include, but are not limited to, micro-fluid jet ejection of conductive inks, sputtering, chemical vapor deposition, and the like.

Formation of the conductive traces 30 on the sloped side walls 22 for connection to the fluid ejection actuators 26 may be achieved as by use of a photoresist masking layer that is photoimaged and developed to provide a mask for etching a blanket deposition of a conductive material for providing the conductive traces 30. If a positive photoresist material is used to pattern the conductive material, the conductive material is typically deposited prior to applying the photoresist material to the substrate 10. If a negative photoresist material is used, a thin film metal deposition step will typically follow patterning and developing the photoresist material.

The contact pads 34 for electrical connection to the semiconductor chip 14 may also be formed by conventional semiconductor processing techniques. Such contact pads 34 may be solder bumps or stud bumps made of a highly conductive material such as gold, gold/tin alloy, silver, or copper, and may be deposited to provide the contact pads 34 that are adjacent to the valley floor 32 as shown in FIG. 3.

Figure 4:
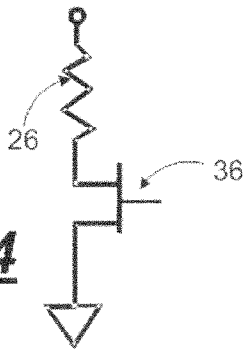
FIG. 4 is an electrical schematic for electrical routing of a semiconductor device on a substrate according to the disclosure.

Once the fluid ejection actuators 26, conductors therefor, conductive traces, and contact pads 34 have been formed, the semiconductor chip 14 is attached to the contact pads 34, such as by a flip chip technique, to provide electrical flow communication between the semiconductor chip 14 and the fluid ejection actuators 26. In one embodiment, the semiconductor chip 14 provides fluid ejection actuator drivers 36, as illustrated in the electrical schematic of FIG. 4. In the embodiment of FIG. 4, each chip 14 may provide device drivers 36 for over 1000 fluid ejection actuators 26.

Figure 5:
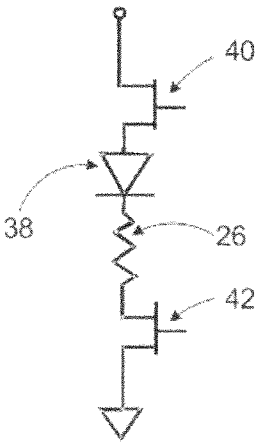
FIG. 5 is an alternative electrical schematic for electrical routing of a semiconductor device on a substrate according to the disclosure.

In an alternate embodiment, a diode array containing diodes 38 may be used to provide a reduced number of chips 14 for activating the fluid ejection actuators 26 according to the electrical schematic of FIG. 5. The diode array may provide a matrix control scheme of row and column FET devices 40 and 42 in the chip 14 that may be used to select the ejection actuators 26 for firing. Compared to the embodiment illustrated in FIG. 4, the alternate embodiment of FIG. 5 may require about 75 percent less semiconductor material for the ejection head 12 thereby significantly lowering the cost to produce such large array ejection heads 12. However, this embodiment may require one diode 38 for each ejection actuator 26 be provided on the substrate 10.

After the chip 14 has been attached to the contact pads 34, an encapsulant material 44 may be deposited in the valley 18 to protect the electrical connections between the chip 14, the contact pads 34, and the conductive traces 30 and to planarize the substrate 10 as shown in FIG. 3. The encapsulant material 44 may be selected from a wide range of substantially non-conductive epoxy and acrylic material that are suitable for semiconductor fabrication purposes. Providing the encapsulant material 44 in the valleys 18 may be useful for preventing or reducing an accumulation of fluid in the valleys 18 upon ejection of fluid from the micro-fluid ejection head 12.

The ejection head 12 may also include one or more fluid supply slots 46 therein for providing fluid flow from a fluid reservoir to the fluid ejection actuators 26. Each fluid supply slot 46 may be machined or etched in the substrate 10 by conventional techniques such as deep reactive ion etching, chemical etching, sand blasting, laser drilling, sawing, and the like, to provide fluid flow communication from the fluid source to the device surface 16 of the substrate 10. The plurality of fluid ejection actuators 26 may be provided adjacent to one or both sides of the fluid supply slots 46.

Figure 6:
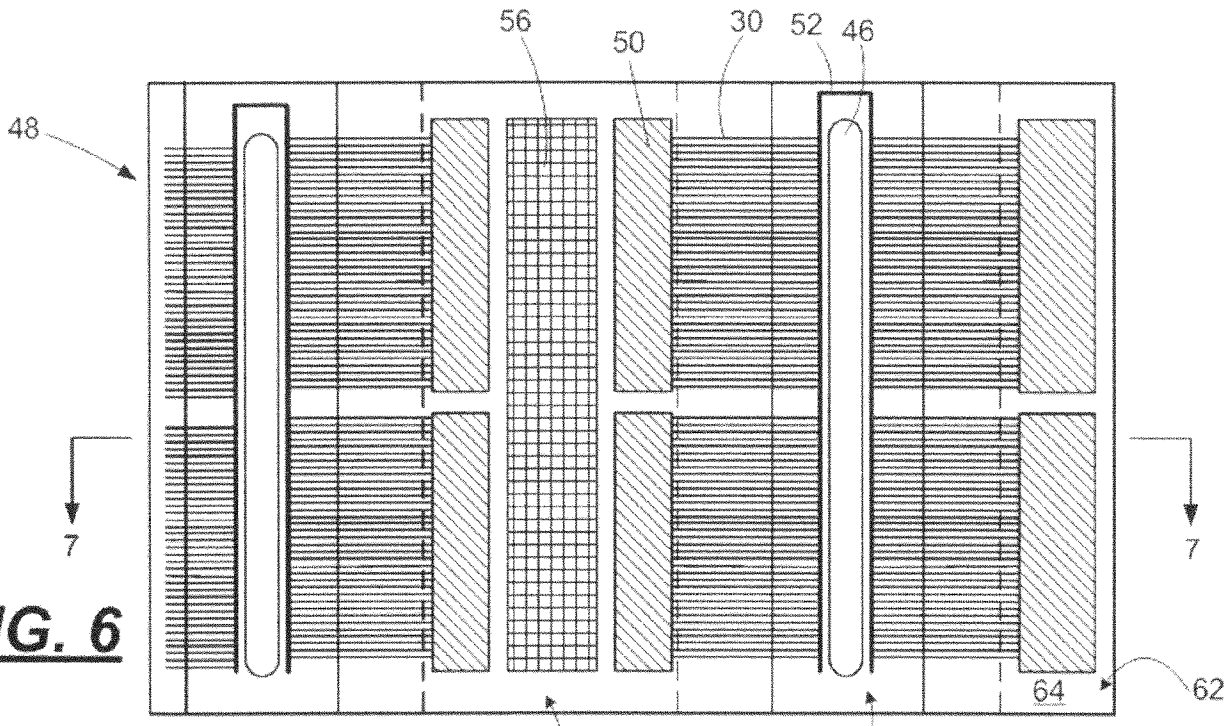
FIG. 6 is a plan view of a portion of a micro-fluid ejection head having semiconductor devices and a ground bus in a substrate valley according to another embodiment of the disclosure.

FIG. 6 illustrates a plan view of an ejection head 48 providing for arrays 50 of driver chips 14 electrically connected to the fluid ejection actuators 26 adjacent the slots 46 by the conductive traces 30. A common conductive trace 52 may circumscribe a portion of the slot 46 and a substrate valley 54, as generally described above, may be large enough to include a ground conductor 56. In the alternative, the ground conductor 56 may be deposited adjacent a substrate peak 58.

Figure 2:
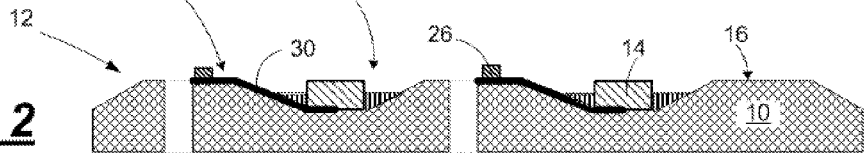
FIG. 2 is a cross-sectional view of the micro-fluid ejection head of FIG. 1.
Figure 7:
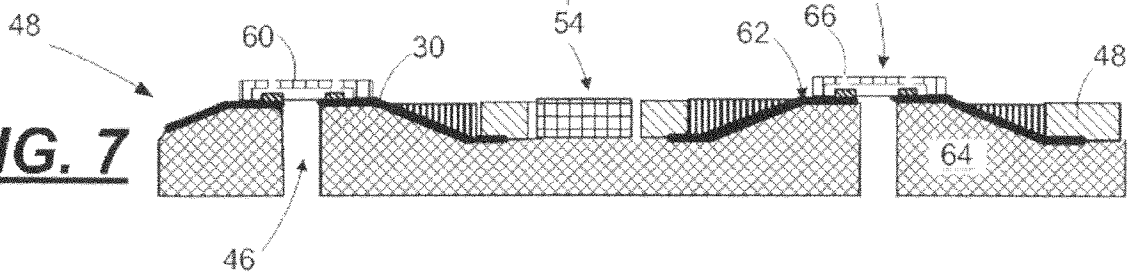
FIG. 7 is a cross-sectional view of the micro-fluid ejection head of FIG. 6.

In FIG. 7, a nozzle plate 60 has been deposited or attached adjacent to a device surface 62 of the substrate 64 to provide nozzles 66 for the actuator devices 26 (FIG. 1). The nozzle plate 60 may be made of any conventional nozzle plate material known to those skilled in the art.

In a further alternate embodiment, a substrate for the ejection head 12 or 48 may be selected from a metal such as tantalum, titanium aluminum, stainless steel, and the like, with a thin oxide layer deposited or formed adjacent to a device surface of the substrate. In this alternate embodiment, the substrate may provide both thermal conductivity properties as well as a ground plane for electrical connection between the actuators and/or driver device. In all other respects, the metal substrate may be configured in a manner set forth in this disclosure to provide control of the actuator devices deposited thereon.

It is contemplated, and will be apparent to those skilled in the art from the preceding description and the accompanying drawings that modifications and/or changes may be made in the embodiments of the disclosure. Accordingly, it is expressly intended that the foregoing description and the accompanying drawings are illustrative of exemplary embodiments only, not limiting thereto, and that the true spirit and scope of the present disclosure be determined by reference to the appended claims.

What is claimed is:

1. A micro-fluid ejection head comprising:

a substrate having a plurality of fluid ejection actuator devices adjacent to a device surface thereof and a valley adjacent to the device surface of the substrate;

a semiconductor chip associated with the plurality of fluid ejection actuator devices, the chip being in the valley adjacent the device surface of the substrate;

a conductor material deposited adjacent to the device surface of the substrate, wherein the deposited conductor material generally conforms to the valley, the conductive material being in electrical flow communication with the chip; and a glaze layer adjacent to the device surface of the substrate to provide a surface roughness of less than about 7.5 nanometers.

2. The micro-fluid ejection head of claim 1, further comprising a nozzle plate adjacent to the device surface of the substrate.

3. The micro-fluid ejection head of claim 1, further comprising a fluid supply slot in the substrate and adjacent to the plurality of fluid ejection actuators, the fluid supply slot providing for flow of fluid from a fluid supply surface of the substrate to the device surface of the substrate, the fluid supply surface being opposite the device surface.

4. The micro-fluid ejection head of claim 1, wherein the substrate comprises a material selected from the group consisting of glass, ceramic, metal, and plastic.

5. The micro-fluid ejection head of claim 1, wherein the substrate comprises a large array substrate having a length greater than about 2.5 centimeters.

6. The micro-fluid ejection head of claim 1, wherein the valley has a depth ranging from about 400 to about 800 microns.

7. The micro-fluid ejection head of claim 1, wherein the plurality of fluid ejection actuators are located on a peak area of the substrate adjacent the at least one valley.

8. The micro-fluid ejection head of claim 1, further comprising an encapsulant material substantially filling the at least one valley to substantially planarize the device surface.

9. The micro-fluid ejection head of claim 1, further comprising a nozzle plate layer adjacent to substantially all of the device surface of the substrate.

10. The micro-fluid ejection head of claim 1, further comprising a nozzle plate layer adjacent to a peak area of the substrate adjacent the valley.

11. The micro-fluid ejection head of claim 1, further comprising a plurality of chips associated with the plurality of fluid ejection actuator devices.

12. The micro-fluid ejection head of claim 1, wherein the valley has a side wall having a slope that provides a connecting trace radius area that is a square root of two times a depth of the valley.

13. A micro-fluid ejection head comprising:

a substrate having a plurality off fluid ejection actuator devices adjacent to a device surface thereof and a valley adjacent to the device surface of the substrate;

a semiconductor chip associated with the plurality of fluid ejection actuator devices, the chip being in the valley adjacent the device surface of the substrate;

a conductor material deposited adjacent to the device surface of the substrate, wherein the deposited conductor material generally conforms to the valley, the conductive material being in electrical flow communication with the chip; and wherein the valley has a side wall having a slope that provides a connecting trace radius area that is a square root of two tines a depth of the valley.

* * * * *